US006571397B1

(12) United States Patent
Williams

(10) Patent No.: US 6,571,397 B1
(45) Date of Patent: Jun. 3, 2003

(54) PROTECTIVE GARMENTS

(76) Inventor: Cole Williams, 1020 Hamilton Rd., Unit G, Duarte, CA (US) 91010

( * ) Notice: Subject to any disclaimer, the term of this patent is extended or adjusted under 35 U.S.C. 154(b) by 133 days.

(21) Appl. No.: 09/662,240

(22) Filed: Sep. 14, 2000

(51) Int. Cl.[7] ..... A41B 11/00
(52) U.S. Cl. ..... 2/239; 2/159; 156/212
(58) Field of Search ..... 2/239, 174, 4, 2/202, 69, 79, 243.1, 159, 164, 161.7, 167, 410, 457, 82, DIG. 1, DIG. 3; 36/4, 9 R, 10, 25 R; 12/142 G; 264/219, 222, 241; 156/212, 213, 306.6, 308.2, 308.6, 309.6, 290; 428/175, 182, 408, 299.1, 902; 442/246, 248–250, 285, 286, 296, 76, 77, 86

(56) References Cited

U.S. PATENT DOCUMENTS 4,217,386 A * 8/1980 Arons et al. ..... 156/182
RE30,892 E * 3/1982 Bingham et al. ..... 428/241
4,513,047 A * 4/1985 Leach et al. ..... 428/175
5,695,853 A * 12/1997 Billingsley et al. ..... 2/102
5,743,775 A * 4/1998 Baurmeister ..... 2/16

* cited by examiner

*Primary Examiner*—John J. Calvert
*Assistant Examiner*—Tejash Patel
(74) *Attorney, Agent, or Firm*—James E. Brunton

(57) ABSTRACT

Protective garments, such as gloves and socks and the method of making the same that are comfortable to wear and at the same time provide a high degree of protection to the user against exposure to various chemical vapors, and hazardous agents including noxious gases.

18 Claims, 4 Drawing Sheets

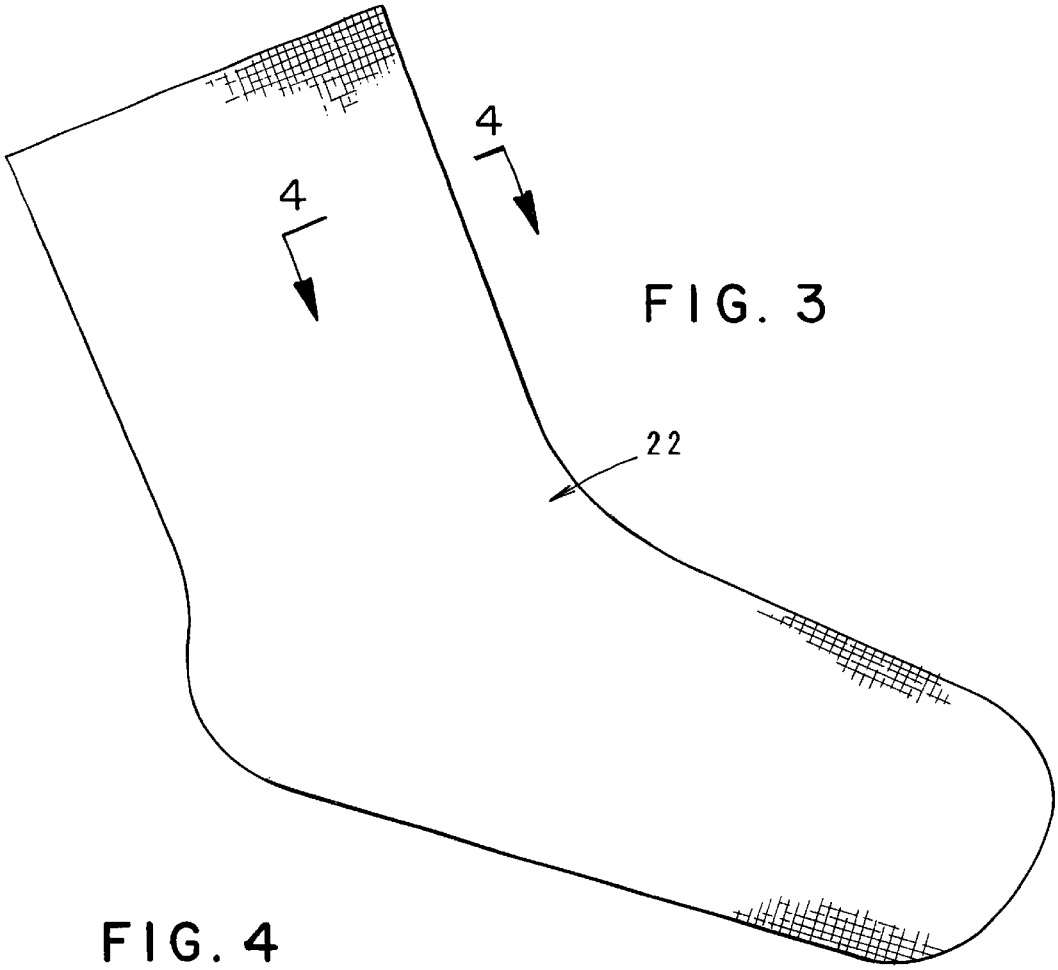
FIG. 3
FIG. 4
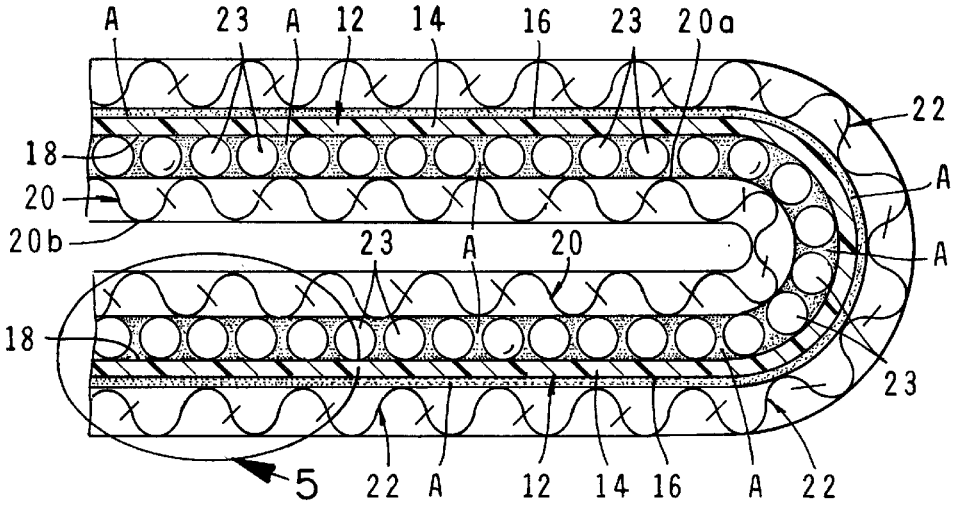

FIG. 5
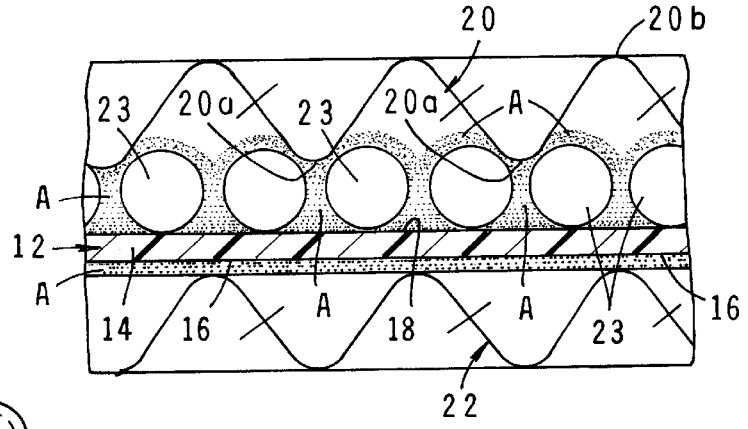
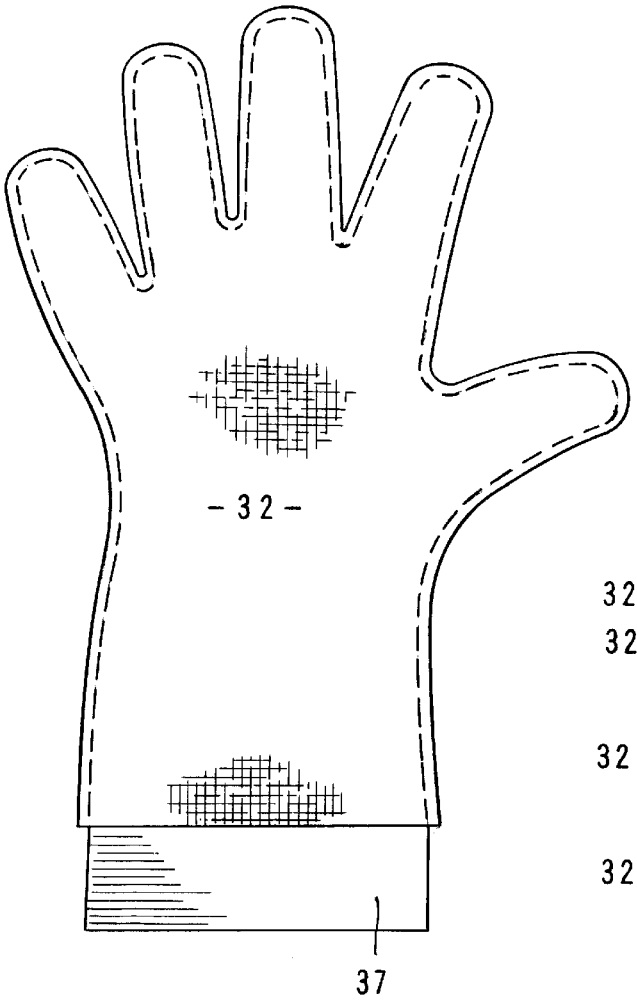
FIG. 6
FIG. 9
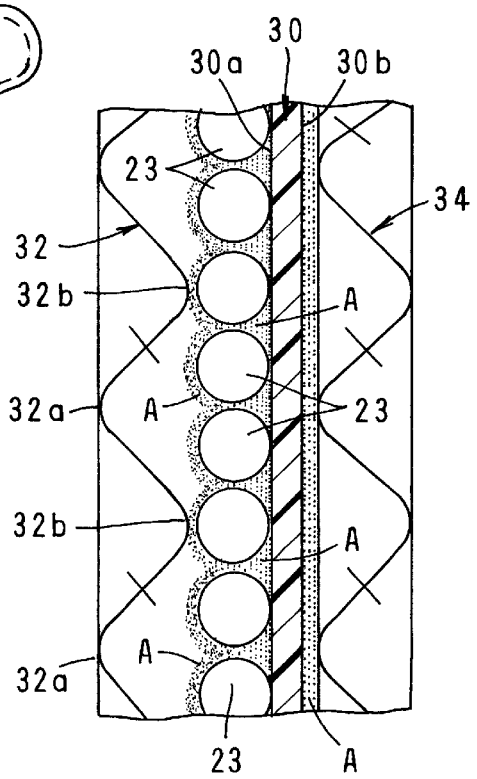

PROTECTIVE GARMENTS

BACKGROUND OF THE INVENTION

1. Field of the Invention

The present invention relates generally to protective garments. More particularly, the invention concerns articles of apparel used to cover the wearer's extremities such as gloves and socks that contain activated carbon micro-spheres that adsorb hazardous chemical and toxins to which the wearer may be exposed 2. Discussion of the Prior Art Various attempts have been made in the past to produce articles of apparel such as gloves and socks that will protect the wearer from hazardous chemicals, chemical vapors and other toxins disposed within the environment to which the wearer is exposed. For example, U.S. Pat. No. 4,513,047 issued to Leach discloses sorbent, internally ribbed carbon-containing material and protective garments fabricated therefrom. The Leach material comprises at least one layer of an activated woven carbon fabric plus a body side, high absorbency rayon layer interposed between at least one woven carbon fabric layer and the wearer's body. Similarly, U.S. Pat. No. 3,769,144 issued to Economy discloses a quilted fabric suitable for making protective garments that contain high surface area carbon fibers. The Economy quilted fabrics is made by uniting a central layer of flexible activated carbon fibers between a pair of outer layers of reinforcing fabric positioned on each side of the layer of activated flexible carbon fibers with a network of quilting stitching.

While the prior art materials that have been used in the construction of protective garments are generally satisfactory for sorbing toxic chemical vapors and the like, the garments constructed from the carbon containing material, typically exhibit limited stretchability thereby making them less than ideally suited for construction of footwear and gloves. In addition, such prior art garments often tend to be bulky and uncomfortable.

As will be better appreciated from the discussion which follows, the protective garments of the present invention provide, for the first time, gloves and footwear, such as socks, which exhibit comfort and stretchability and, at the same time are highly effective in protecting the wearer from hazardous materials such as chemical vapors, noxious gases and the like.

SUMMARY OF THE INVENTION

It is an object of the present invention to provide protective garments, such as gloves and socks and the method of making the same that are comfortable to wear and at the same time provide a high degree of protection to the user against hazardous exposure to various chemical vapors, and agents including noxious gases.

A particular object of the invention is to provide a protective footwear article of the aforementioned character, which fits well, is pliant and is durable in use.

Another object of the invention is to provide a protective article such as a glove or sock that is easy to don, is comfortable to wear and, at the same time, provides substantial protection to the user against exposure from hazardous chemical vapors.

Another object of the invention is to provide a method of making protective garments of the character described in the preceding paragraphs that is simple and straight forward, does not require the use of complicated equipment such as sewing and seaming equipment and can be performed by unskilled workmen with a minimum of training.

A particular object of the invention is to provide socks and gloves of the character as described in the preceding paragraphs that are of simple construction and are easy to manufacture. In its preferred form, the footwear article of the invention comprises a sock which is of three-ply construction with the inside and outside plies being knit and the intermediate ply being made from an elastomeric polyurethane film to which a multiplicity of activated carbon micro-spheres have been affixed. The three-plies are uniquely bonded together using a pliant, waterproof adhesive.

In its preferred form, the gloves of the invention are also of three-ply construction with the inside and outside plies being knit and the intermediate ply being made from an elastomeric polyurethane film to which a multiplicity of activated carbon micro-spheres have been affixed. As in the footwear construction, the three-plies are uniquely bonded together using a pliant, waterproof adhesive.

BRIEF DESCRIPTION OF THE DRAWINGS

FIG. 3 is a side-elevational view of one form of the footwear article of the invention.

FIG. 4 is an enlarged, cross-sectional view taken along lines 4—4 of FIG. 3.

FIG. 5 is a fragmentary, cross-sectional view of the area designated as "5" in FIG. 4.

FIG. 6 is a top plan view showing the stretchable bladder component of the protective glove article of the invention in position over the glove mandrel.

FIG. 9 is an enlarged, fragmentary, cross-sectional view of the area designated in FIG. 8 as 9.

DESCRIPTION OF THE INVENTION

The term "fabric" as used herein means a sheet structure made from fibers, filaments or yams. Non-limiting examples include woven or non-woven sheets made by weaving, knitting felting, hydroentangling or meltblowing fibers, filaments or yams.

The term "sock" as used herein means a short, close fitting covering for the foot and lower leg constructed from any suitable material such as natural and synthetic fibers.

The term "glove" as used herein means a covering for the hand and a wrist constructed from any suitable material such as natural and synthetic fibers.

The term "carbon micro-sphere" as used herein means a carbon micro-sphere commercially available from sources such as Tex-Shield, Inc. located at 8000 Midlantic Drive, Suite 110, South, Mount Laurel, N.J. 08054.

Figures 1, 2:
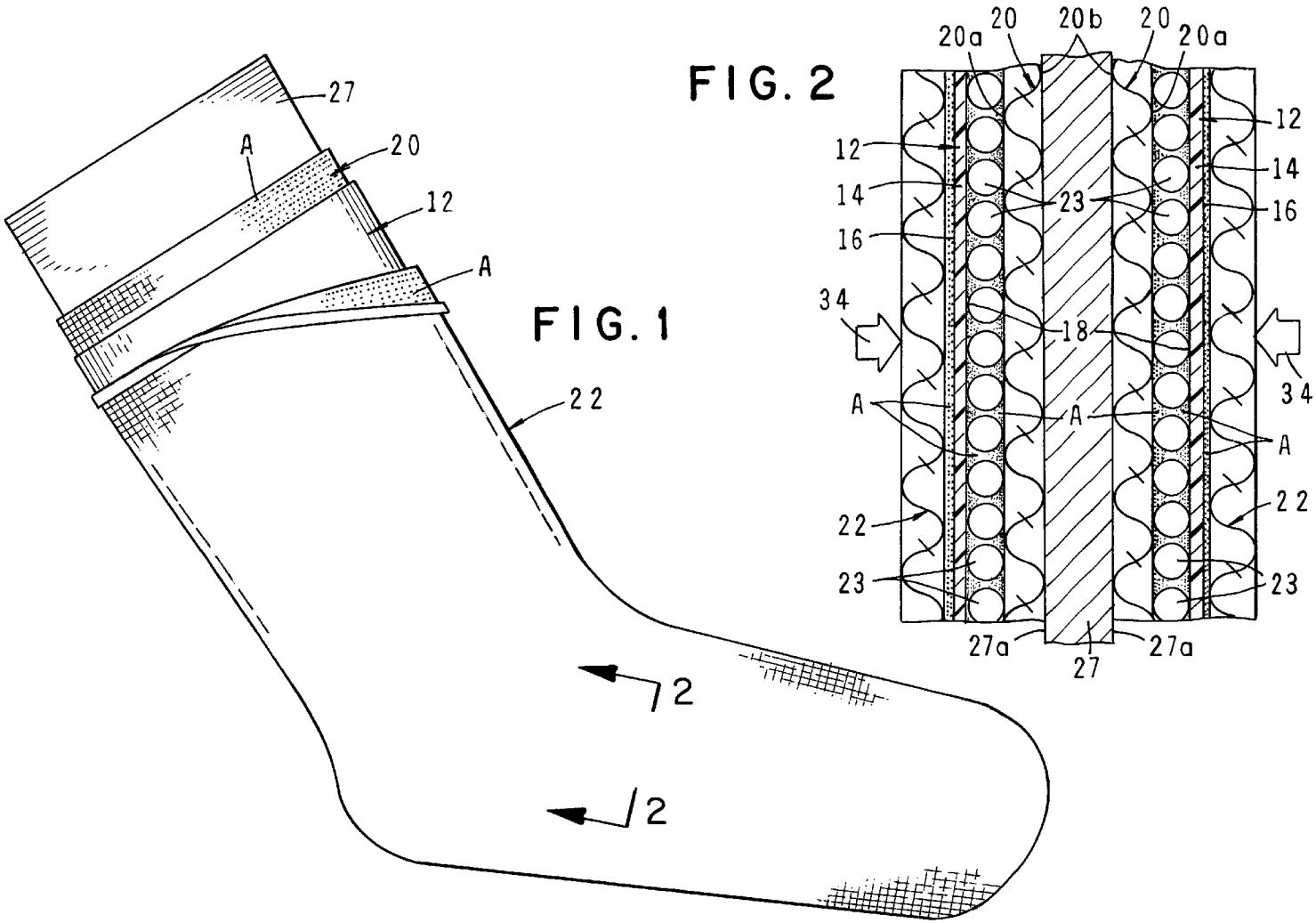
FIG. 1 is a side-elevational view illustrating the method of making the footwear article of the invention and showing the components of the article in position over a foot-shaped planar mandrel
FIG. 2 is an enlarged, cross-sectional view taken along lines 2—2 of FIG. 1.

Referring to the drawings and particularly to FIGS. 1 through 5, one form of the protective garment of the present invention is there shown. The garment here comprises a sock construction including a thin, pliant bladder 12 constructed from an elastomeric, material, such as a polyurethane sheet. The polyurethane sheet can be of various thicknesses as, for example, between about 0.5 mils and about 3 mils. Bladder 12 includes a foot portion 14 having an outer surface 16 and an inner surface 18 (FIG. 2). Bladder 12 has the unique capability of generally conforming to the contours of the human foot so that it can be comfortably worn inside a boot or shoe. Bonded to the inner surface 18 of the elastomeric bladder is a lightweight covering member such as a fabric inner sock 20 of standard construction, which is preferably made from knitted natural or synthetic fibers.

The footwear article of the invention shown in FIG. 1 also includes an outer sock 22, which is disposed proximate the outer surface of bladder 12. Outer sock 22 can also be constructed from filament or spun yarns. The sock can also be constructed from natural fibers such as wool fibers, or from a variety of synthetic fibers such as polyester, nylon and combinations thereof.

As best seen in FIG. 5, disposed between bladder 12 and the inner sock 20 are a multiplicity of activated carbon micro-spheres generally designated as 23. Micro-spheres 23 are generally commercially available from a number of sources such as Tex Shield, Inc. and can vary in diameter from between about 0.0005 inches and about 0.040 inches. In use, micro-spheres 23 are constructed and arranged so as to substantially absorb a number of different hazardous chemical agents such as, by way of example, toxic chemical vapors and airborne chemicals and toxins.

Outer sock 22 is preferably bonded to bladder 12 by means of a waterproof, heat-activated adhesive "A". A hot melt adhesive in powder form sold by Bostik, Middleton, Mass., product #5116, a polyester type, has proven satisfactory for this purpose. Other suitable adhesives can, of course, also be used. Similarly, inner sock 20 is bonded to bladder 12 and to micro-spheres 23 by means of a similar waterproof heat activated adhesive "A".

For certain applications, the footwear article of the invention can be constructed by bonding to the bladder only a single inner or outer sock. This two, rather than three-ply construction, can be used in a number of applications in which the three or more ply constructions are not necessary.

The thin, pliant, thermoplastic material from which the bladder is made can, by way of example, be a polyurethane sometimes described as thermoplastic urethane. A suitable material of this type is sold by the Dow Chemical Co., Midland, Mich. Other suitable materials include elastomers made from polyesters, copolyesters, polyamides, cellulose derivatives, polyacrylic acid and its hologs, natural or synthetic rubber with hydrophilic impurities, copolyozamides, polyureas, polyelectrolytes, polyphosphates, polyvinylamid, polyvinylalcohol, polyether, and copolymers thereof, polythioether, polythiether-polyether, copolyephichlorohydrin-ether, polysulphosphates, copolyester-ether and derivatives or mixtures thereof.

Considering now the method of the invention for making the protective footwear article, a first surface of the thin, pliant membrane bladder material, the second surface of which is preferably backed by a paper backing, is uniformly covered with a layer of carbon activated micro-spheres that are positioned in a closely adjacent relationship. The micro-spheres can be connected to the membrane by any suitable heat activated adhesive such as the powdered hot melt adhesive such as Bostik No. 5116, or by using a suitable liquid cured or air dryed adhesive. Following the interconnection of the micro-spheres with the first surface of the bladder, the paper backing is removed from the second surface to form a membrane substrate. Next, the second surface of the bladder portion of the membrane substrate is uniformly coated with the heat activated powdered adhesive and controllably heated to fuse the particles of adhesive to the bladder. This done, the carbon micro-sphere-coated surface is uniformly coated with a heat activated powdered adhesive and controllably heated to fuse the particles of adhesive to the micro-sphere-coated bladder surface. Importantly during the coating of the micro-sphere coated surface with the powdered adhesive, the membrane substrate is vibrated to cause the adhesive particles to fall between the micro-spheres.

The next step in one form of the method of the invention is the construction of the bladder component. This is accomplished by overlaying two sheets of the previously described adhesive-carbon, micro-sphere-coated bladder material so that the sides with the micro-spheres are in a face-to-face relationship. This done, the two sheets of material are heated along the boundary line to a temperature sufficient to sealably bond the sheets together along the boundary line to form a carbon micro-sphere bladder substrate. One technique, which has proven to be satisfactory in forming the carbon micro-sphere-bladder substrate, involves the use of a heated platen press embodying a die having the general shape of the outer boundary line of the garment. In accordance with this technique, with the micro-sphere coated sheets in position within the press, compressed air having a line pressure of about 120 to about 130 pounds per square inch is applied to the press. This done, the die is electrically heated to between about 500 and 600 degrees Fahrenheit for a period of about 5 to 20 seconds. This controlled heating of the dies causes the sheets of bladder material to be effectively welded, or sealably joined together along the boundary line to make the sock shaped, carbon micro-sphere bladder substrate. After the welding process, the excess material outside the bladder boundary is manually stripped away and the assemblage is removed from the platen press. By these means, the construction of a sock-shaped bladder component with a multiplicity of activated carbon micro-spheres affixed to either the inner surface or the outer surface, has been accomplished.

The next step in the method of the invention is to place the first covering member, or inner sock 20 over a generally foot-shaped, approximately $1/16^{th}$ inch thick, generally planar aluminum mandrel 27. Inner sock 20, which has inner and outer surfaces 20*a* and 20*b*, is placed over the mandrel so that inner surface 20*a* thereof is disposed in engagement with the faces 27*a* of mandrel 27 (FIG. 2). As previously discussed, inner sock 20 can be constructed from a variety of materials. However, a sock which is made by Wigwam Mils, Inc. of Sheboygan, Wis. special knit pattern of its standard BK-1188 has proven satisfactory. For warm weather comfort, the inner sock can be made utilizing Coolmax. RTM made by duPont.

After the inner sock 20 has been placed over mandrel 27 and smoothed out so that its inner surface is in close engagement with the faces of the mandrel 27, the sock-shaped, carbon micro-sphere bladder substrate, which has been adhesive coated with particles of hot melt adhesive inside and outside is carefully placed over the assemblage of inner sock 20 and mandrel 27 so that the carbon micro-sphere side is in engagement with sock 20. The bladder is then smoothed so that the micro-sphere-coated surface thereof is in close engagement with the outer surface of inner sock 20. Outer sock 22 is next placed over both the inner sock 20 and the adhesive-carbon micro-sphere coated bladder substrate.

The precursor assembly comprising first inner sock 20, the adhesive coated carbon micro-sphere carrying substrate 12 and the second outer sock 22 is then heated and compressed in the direction of the arrows 34 in FIG. 2 to form the finished article. This step is accomplished by placing the mandrel, upon which the precursor assembly is mounted, between two platens which can be controllably heated and urged together. More particularly, the platens are preferably electrically heated to a temperature of between about 250 and 300 degrees Fahrenheit and are controllably moved into pressural engagement with the precursor assembly by any type of hydraulically actuated pressure imparting assembly of a character well known to those skilled in the art. A commercially available press suitable for carrying out the method of the invention is sold by PHI of the City of Industry, Calif. During this temperature-pressure step, the heat-activated adhesive is thereby fused making a permanent bond of inner sock 20 to one side of the bladder and the outer sock 22 to the other side of the bladder. The minimum temperature required to activate the Bostik #5116 adhesive is 268 degrees Fahrenheit. Accordingly, a temperature range of between about 270 degrees Fahrenheit and 290 degrees Fahrenheit is preferred. During this temperature-pressure step portions 20*a* of the fabric of the inner sock is urged into the spaces between the micro-spheres in the manner shown in FIG. 5 and into engagement with the adhesive "A" for secure bonding.

The precursor assembly is then removed from the press and allowed to cool thoroughly prior to doffing the completed footwear article or garment from the mandrel.

When removed from the mandrel, the footwear article is generally planar in shape. However, upon inserting the foot into the open cuff of the article, the foot-engaging portion of the sock will neatly and smoothly conform to the shape of the wearer's foot.

When the adhesive used is in liquid form it can be sprayed, brushed or otherwise applied to the elastomeric bladder or sock fabric. As previously stated when as the powered adhesive is applied to the bladder and to the carbon micro-spheres it is gently vibrated and thus not degrading sorbing capability of the carbon.

Turning now to FIGS. 6 through 9 of the drawings, another form of protective garment of the invention can be seen to comprise a glove construction that includes a thin, pliant membrane bladder constructed from any of the materials previously identified herein. As before, the bladder can be of various thicknesses ranging from about 0.5 mils to about 3.0 mils. Extruded material available from the Dow Chemical Company has been proven to be quite satisfactory for use in constructing both the sock and glove articles of the invention. Bonded to the inner surface 30*a* of the elastomeric membrane bladder 30 is a lightweight covering member such as a fabric inner glove 32 of standard construction, which is preferably made from knitted natural or synthetic fibers.

The protective glove garment of the invention also includes an outer glove 34, which is disposed proximate the outer surface 30*b* of bladder 30. Outer glove 34 can also be constructed from filament or spun yarns. The glove 34 can also be constructed from natural fibers; such as wool fibers or from a variety of synthetic fibers such as polyester nylon and combinations thereof.

Figure 8:
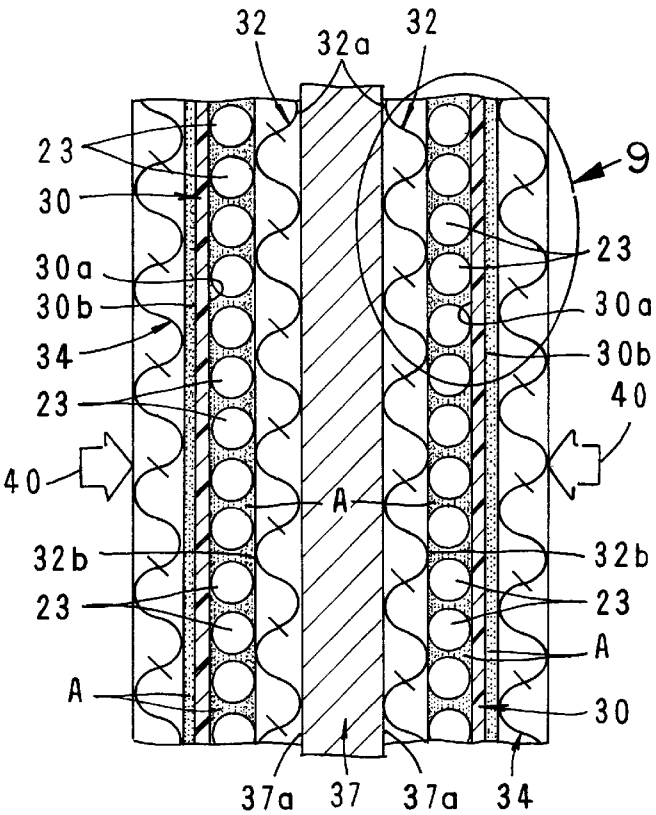
FIG. 8 is an enlarged, cross-sectional view taken along lines 8—8 of FIG. 7.

Disposed between bladder 30 and inner glove 32 are a multiplicity of activated carbon micro-spheres generally designated by 23. Micro-spheres 23 are of the character previously described and perform the important function of adsorbing hazardous chemical vapors and other noxious materials (FIGS. 8 and 9).

Inner glove 32 is preferably bonded to bladder 30 and to micro-spheres 23 by means of a selected one of the previously described waterproof, heat activated adhesives. Similarly, glove 34 is bonded to bladder 30 by means of a similar heat activated adhesive "A".

For certain applications the glove of the invention can be constructed by bonding to the bladder only a single inner or outer glove. This two, rather than three-ply construction, can be used in a number of applications in which the three or more ply constructions are not necessary.

As described in an earlier embodiment of the invention, the glove bladder can, by way of example, be constructed from a polyurethane described as thermoplastic urethane and available from various commercial sources such as the Dow Chemical Company.

Considering next the method of the invention for making the protective glove garment, this method is similar in many respects to the method described for making the sock garment and makes use of a thin, pliant bladder material that is backed by a paper backing. As before, one surface of first bladder 30 is covered with a layer of carbon activated micro-spheres 23 that are of the character previously described and are positioned in a closely adjacent relationship (see FIGS. 8 and 9). The micro-spheres can be connected to the bladder material by any suitable liquid adhesive or any powered hot melt adhesive of the type previously described herein that is preferably applied to the bladder in a dot matrix configuration. Following the interconnection of the micro-spheres, the bladder adhesive is applied to the micro-sphere coated side of the substrate and heated. As before, the substrate is gently vibrated to cause the adhesive particles to fall between the micro-spheres (see FIG. 5). After removal of the paper backing, adhesive particles are next randomly distributed over the opposite side of the bladder and are controllably heated to a temperature slightly above the softening point of the adhesive, thereby causing the adhesive particles to fuse to the surface of the bladder.

The next step in this latest method of the invention is the construction of the bladder component. As before, this step is accomplished by overlaying two sheets of the previously described membrane substrate, or adhesive-carbon, micro-sphere coated bladder material, so that the sides with the micro-spheres are in face-to-face contact. This done, the two sheets of material are heated along the boundary line to a temperature sufficient to sealably bond the sheets together along the boundary line to form a carbon micro-sphere bladder substrate. One technique that has proven to be satisfactory for forming the carbon micro-sphere bladder substrate involves the use of a heated platen press similar to that previously described, which embodies a die having the shape of an outer boundary line that generally corresponds to the shape of the hand. In this connection, with the micro-sphere coated sheets in position within the press, compressed air at a pressure of about 120 to about 130 pounds per square inch is exerted on the press and the die is electrically heated to between about 500 and about 600 degrees Fahrenheit for a period of about 5 to 9 seconds. This controlled heating of the dies causes the sheets of the micro-sphere coated bladder material to be effectively welded, or sealably joined together along the boundary line to make the glove-shaped carbon micro-sphere-bladder substrate. After the welding process has been completed, the excess material outside the bladder boundary is manually stripped away and the assemblage is removed from the platen press. By these means, a glove-shaped bladder component with a multiplicity of activated carbon micro-spheres affixed to the outer surfaces and with discrete particles of hot melt adhesive affixed to both the inside and the outside surfaces of the glove-shaped carbon micro-sphere bladder substrate, has been completed.

The next step in the method of the invention is to place the first covering member, or inner glove 32 over a generally hand-shaped, approximately $1/16^{th}$ inch thick, generally planar mandrel 37 (see FIG. 6). Inner glove 32, which has inner and outer surfaces 32*a* and 32*b* (FIG. 8) is placed over the mandrel so that inner surface 32*a* thereof is disposed in engagement with the faces 37*a* of mandrel 37. Inner sock 32 can be constructed from a variety of materials of the character previously described herein.

Figure 7:
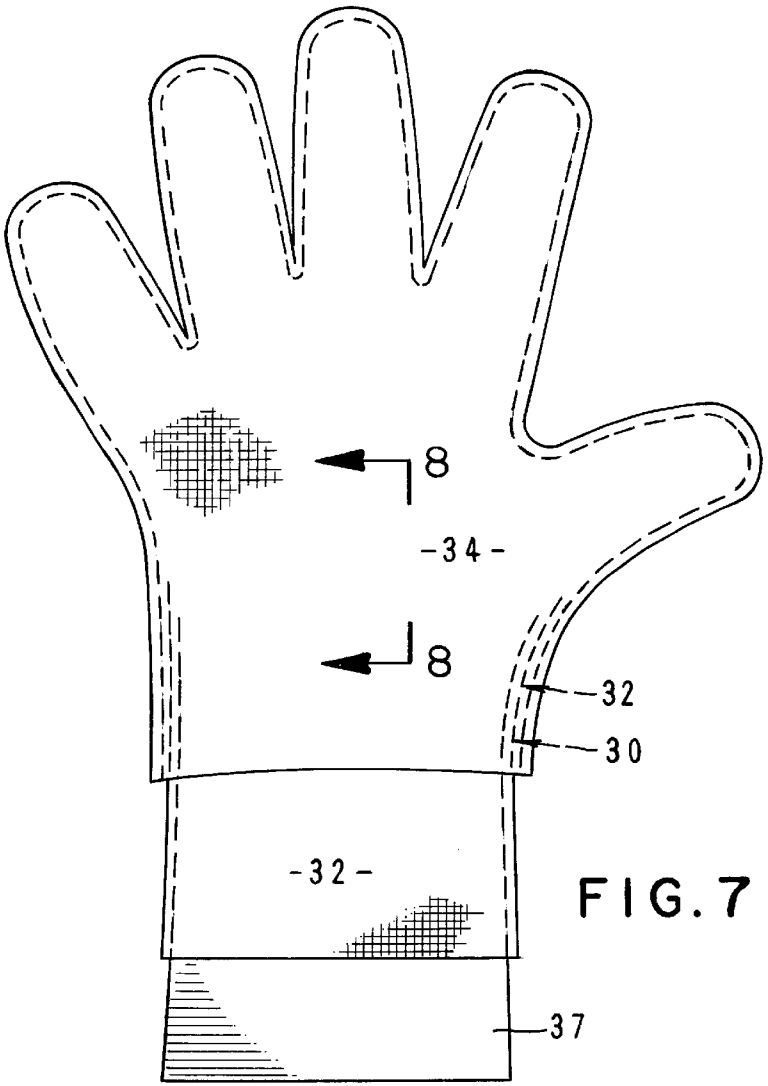
FIG. 7 is a top plan view similar to FIG. 6, but showing the outer covering component of the glove in position over the inner liner, the bladder, and the mandrel.

After inner glove 32 has been placed over mandrel 37 and smoothed out so that its inner surface 32*a* is in close engagement with the faces of the mandrel 37, the glove-shaped carbon micro-sphere bladder substrate, which has been adhesive coated with particles of hot melt adhesive inside and outside is carefully placed over the assemblage of inner glove 32 and mandrel 37 with the carbon micro-sphere side in engagement with glove 32 (FIG. 9). The bladder is smoothed so that the carbon micro-sphere-coated surface thereof is in close engagement with the outer surface 32*b* of inner glove 32. Outer glove 34 is then placed over both the inner sock 32 and the adhesive-carbon, micro-sphere coated bladder substrate on mandrel 37 (FIG. 7).

The precursor assembly comprising first inner glove 32, the adhesive-coated carbon, micro-sphere carrying substrate and the second outer glove 34 is then heated and compressed in the direction of the arrows 40 in FIG. 8 to form the finished article. This step is accomplished by placing the mandrel, upon which the precursor assembly is mounted, between two platens, which can be controllably heated and urged together. More particularly, the platens are preferably electrically heated to a temperature of between about 260 and 300 degrees Fahrenheit and are controllably moved into pressural engagement with the precursor assembly by any type of hydraulically actuated pressure imparting assembly of a character well known to those skilled in the art. A commercially available press suitable for carrying out the method of the invention is sold by PHI of the City of Industry, Calif. During this temperature-pressure step, the heat-activated adhesive is thereby fused making a permanent bond of inner glove 32 to one side of the bladder and the outer glove 34 to the other side of the bladder. The minimum temperature required to activate the Bostik #5116 adhesive is 268 degrees Fahrenheit. Accordingly, a temperature range of between about 270 degrees Fahrenheit and 290 degrees Fahrenheit is preferred.

The precursor assembly is then removed from the press and allowed to cool thoroughly prior to removing the protective glove garment. When removed from the mandrel, the protective glove is generally planar in shape. However, upon inserting the hand into the open cuff of the glove, the hand-engaging portion of the glove will neatly and smoothly conform to the shape of the wearer's hand.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A protective garment for covering of portion of the user's body comprising:

(a) an elastomeric, stretchable elastic bladder, including as a part thereof a continuous portion in the general shape of the hand or foot to be covered and including a continuous outer surface and a continuous inner surface generally conformable to the hand or foot to be covered;

(b) a multiplicity of carbon micro-spheres interconnected with said continuous inner surface of said bladder; and (c) inner and outer fabric members bonded to said bladder and it to said carbon micro-spheres along a substantial portion of said inner and outer surface of said bladder.

2. The protective garment as defined in claim 1 in which said stretchable, elastic bladder comprises a thin film.

3. The protective garment as defined in claim 2 in which said inner and outer fabric members are bonded to said bladder and to said micro-spheres using a heat-activated adhesive.

4. The protective garment as defined in claim 3 in which said micro-spheres are disposed in a substantially side-by-side relationship.

5. The protective garment as-defined in claim 3 in which the garment comprises a protective sock.

6. The protective garment as defined in claim 3 in which the garment comprises a protective glove.

7. A method of making a protective garment used to cover a portion the hand or foot comprising the steps of:

(a) coating one surface of an elastomeric membrane with a multiplicity of carbon micro-spheres to form a membrane substrate;

(b) forming said membrane substrate into a stretchable bladder having a receiving portion having the general shape of the hand or foot to be covered and including an outer surface and an inner surface generally conformable to the hand or foot to be covered; and (c) bonding a first fabric member to said membrane substrate.

8. A method as defined in claim 7 including the further step of bonding a second covering member to said membrane substrate to form a precursor assembly.

9. The method as defined in claim 8 in which said elastomeric material comprises a thin film.

10. The method as defined in claim 8 in which said first fabric member is bonded to said membrane substrate using a heat-activated adhesive.

11. The method as defined in claim 8 including the further step of heating said precursor assembly.

12. The method of making a protective garment used to cover a portion of the hand or foot comprising the steps of:

(a) affixing a multiplicity of carbon micro-spheres to a surface of an elastomeric membrane to form a membrane substrate;

(b) forming said membrane substrate into a stretchable bladder having a receiving portion having the general shape of the hand or foot to be covered and including an outer surface and an inner surface generally conformable to the hand or foot to be covered;

(c) bonding a first fabric member to said stretchable bladder; and (d) bonding a second fabric member to said stretchable bladder to form a precursor assembly.

13. The method as defined in claim 12 including the further step of exerting pressure on and heating said precursor assembly.

14. The method as defined in claim 12 in which said elastomeric material comprises a thin film.

15. The method as defined in claim 12 in which said first fabric member is disposed adjacent said multiplicity of carbon micro-spheres.

16. The method as defined in claim 12 in which said stretchable bladder has the general shape of a foot.

17. The method as defined in claim 12 in which said stretchable bladder has the general shape of a hand.

18. The method as defined in claim 12, including the further step of applying a powder of adhesive to the membrane substrate and then vibrating the membrane substrate to cause the adhesive to fall between the carbon micro-spheres.

* * * * *